United States Patent [19]

Imler

[11] 4,312,083

[45] Jan. 26, 1982

[54] WATER CLOSET FLUSH VALVE

[76] Inventor: Carl E. Imler, 213 W. Kirwin, Salina, Kans. 67401

[21] Appl. No.: 181,950

[22] Filed: Aug. 27, 1980

[51] Int. Cl.[3] ..... E03D 1/36; E03D 1/06

[52] U.S. Cl. ..... 4/366; 4/370; 4/374; 137/410; 137/411; 137/446

[58] Field of Search ..... 4/374, 366, 377, 370, 4/367, 378; 137/410, 411, 446, 444, 434; 251/38, 44

[56] References Cited

U.S. PATENT DOCUMENTS

| | | | |
|---|---|---|---|
| 1,081,110 | 12/1913 | Gondolf | 137/410 X |
| 1,243,766 | 10/1917 | Schmidt | 137/444 X |
| 1,733,633 | 10/1929 | Sterbenz et al. | 4/367 |
| 2,068,252 | 1/1937 | Weber | 137/410 X |
| 2,093,584 | 9/1937 | Walker | 137/410 |
| 2,177,121 | 10/1939 | Scott | 137/410 |
| 2,700,163 | 1/1955 | Sturman | 137/446 X |
| 2,837,111 | 6/1958 | Mueller | 137/410 |
| 3,424,187 | 1/1969 | Brennan et al. | 137/444 |
| 3,593,740 | 7/1971 | Harrison | 137/411 |
| 4,114,208 | 9/1978 | Imler | 4/366 |

*Primary Examiner*—Henry K. Artis

*Attorney, Agent, or Firm*—Victor J. Evans & Co.

[57] ABSTRACT

A flush valve for a toilet having a tank and a bowl including a valve housing connected to a source of water, a valve stem operatively connected to a float and a piston operatively connected through a cam to a flush lever, the valve stem and piston movable independently to provide a valve for the admission of water to the tank and bowl together with a syphon having a tube therein for breaking the syphon action at a predetermined level of water in the tank, a float operatively connected to the valve stem which automatically varies the float level action and an arm connected to the cam for actuation by the float to return the flush lever to an inoperative position and another valve operated by the piston to interrupt the flow of water into the valve housing to prevent back syphonage of tank water into the water supply line.

12 Claims, 4 Drawing Figures

WATER CLOSET FLUSH VALVE

BACKGROUND OF THE INVENTION

A previous patent obtained by the applicant herein, U.S. Pat. No. 4,114,208 entitled Water Closet Flush Valve covered an invention on a flush valve for a toilet and included a valve housing disposed within the tank, the housing being provided with a valve stem and piston arranged for independent vertical movement to define a valve for communicating the housing with a syphon so that water flowing through the valve induces a syphon action in the syphon to drain the water from the tank into the bowl for a flushing action. The housing communicates with a source of water through another valve actuated by the piston through which water for the syphoning action is obtained as well as providing a source of water for refilling the tank subsequent to the flushing action.

The flushing action in the invention of the aforementioned patent is initiated by the actuation of the toilet flush lever which rotates a cam into camming engagement with the piston separating the piston from the valve stem maintained in the uppermost position by the float and as the float moves downwardly as the water level in the tank drops engagement between the valve stem and piston closes the valve interrupting the syphoning action to permit the tank to be refilled through another valve associated with the valve housing. The rising water in the tank returns the valve stem to the upper position returning the parts to their original position interrupting the introduction of water into the tank.

While very satisfactory results have been obtained with the flush valve of the aforementioned patent, such as the conservation of water, leakproof construction, anti-syphon prevention and positive shut-off, further evaluation of the flush valve has indicated the need for various improvements for even greater efficiency in the operation of the valve.

OBJECTS AND SUMMARY OF THE INVENTION

Accordingly, a primary object of this invention is to provide a new and novel improved flush valve for a water closet in which the component parts function in a highly efficient and positive manner.

Another object of this invention is to provide a new and novel flush valve for a water closet wherein a syphon is utilized for evacuation of the water tank which is extremely quiet in operation and which permits the syphoning action to be terminated at a predetermined level of water in the tank.

Still another object of this invention is to provide a new and novel flush valve for a toilet wherein the lever action of the float is varied in a highly efficient manner thereby providing a quick and silent shut-off of water entering the tank.

A still further object of this invention is to provide a new and novel flush valve for a toilet wherein the back syphonage of tank water into the water supply line is totally eliminated.

Still another object of this invention is to provide a new and novel flush valve for a toilet wherein the operation of the flush lever is accomplished in a highly efficient manner with a minimum of parts and which permits a positive return of the flush lever to its original position following a flushing operation.

The objects stated above and other related objects are accomplished by the provision of a toilet having a tank and a bowl with a valve housing having upper and lower chambers in the tank. A piston and valve stem are slidably disposed within the upper chamber of the valve housing for relative vertical movement and first valve means are defined by cooperating surfaces on the valve stem and piston. A syphon is mounted in the tank which communicates at opposite ends with the tank and the bowl and means are provided for communicating the valve housing lower chamber with a source of water under pressure and for communicating the upper chamber with the tank. Float means responsive to the level of water in the tank are operatively connected to the valve stem and flush means are operatively associated with the piston. Second valve means actuated by the piston are provided in the valve housing for communication between the housing lower and upper chambers which permit water introduced into the lower chamber from the water source to flow linto the upper chamber. Means including the first valve means are provided for communicating the upper chamber with the syphon and third valve means actuated by the piston are provided in the valve housing for preventing a reverse flow of water from the upper chamber into the lower chamber upon an interruption in the communication between the source of water and the lower chamber.

Other objects and advantages will become apparent in the following specification when considered in light of the attached drawings.

DESCRIPTION OF THE PREFERRED EMBODIMENTS

Figure 4:
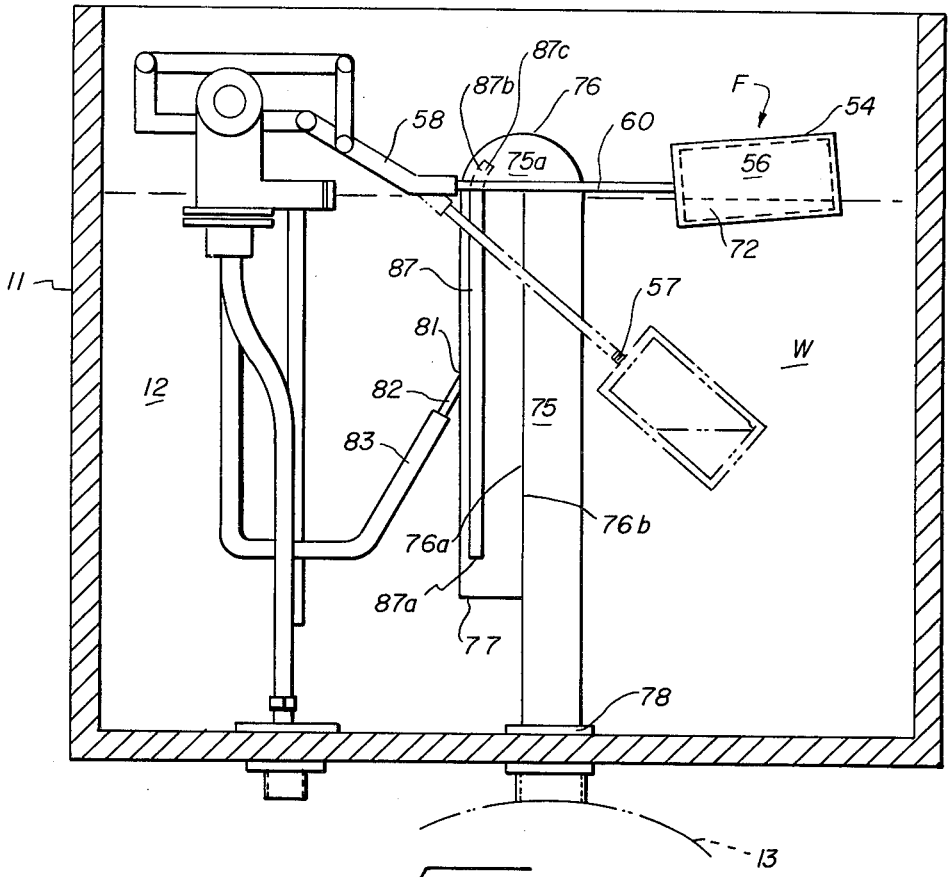
FIG. 4 is a front elevation view of the flush valve of the invention in an installed position with the tank of a water closet.

Referring now to the drawings and to FIG. 4 in particular, there is shown the flush valve of the invention disposed within the water tank 11 of a water closet or toilet (not shown) of conventional construction. As is well known, the tank 11 has an interior 12 which is arranged to be filled with water W to a predetermined level for evacuation out of the tank interior 12 into a bowl 13 (shown diagrammatically by broken lines in FIG. 4) in a typical flushing operation.

Figure 1:
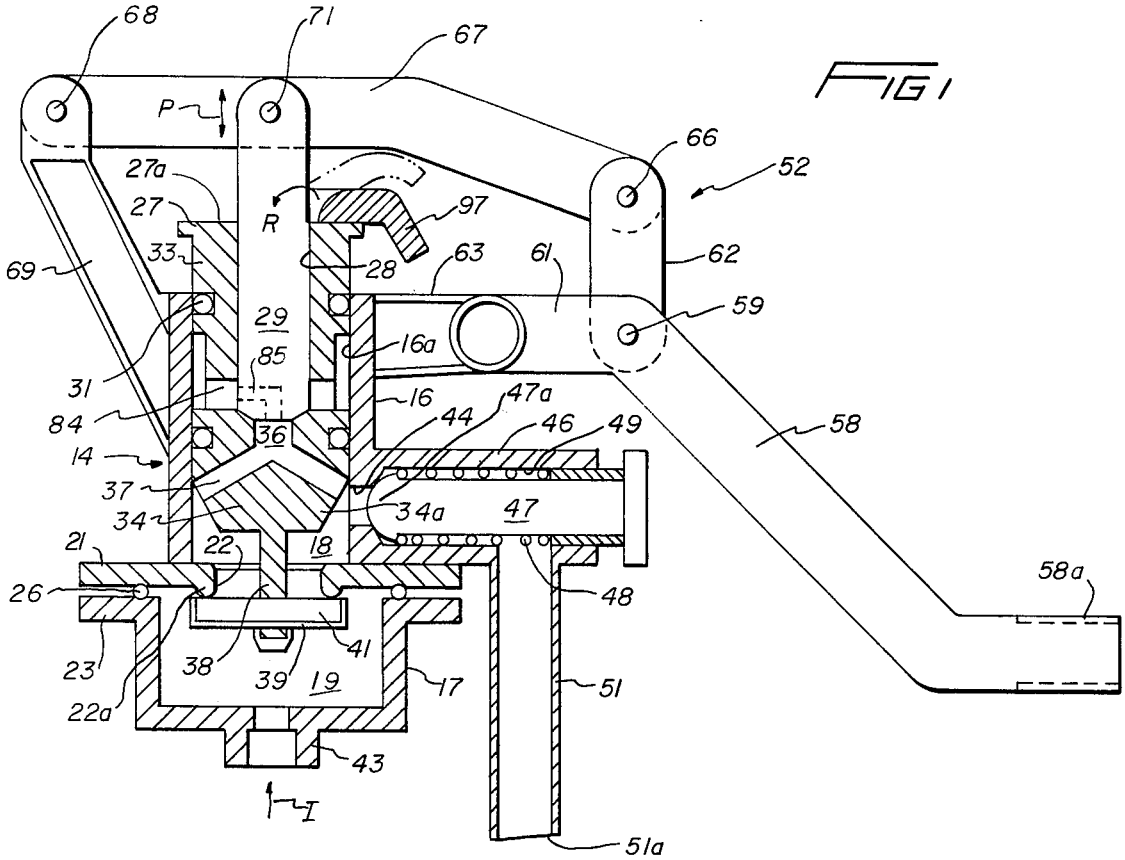
FIG. 1 is a front sectional view of the flush valve of the invention.
Figure 2:
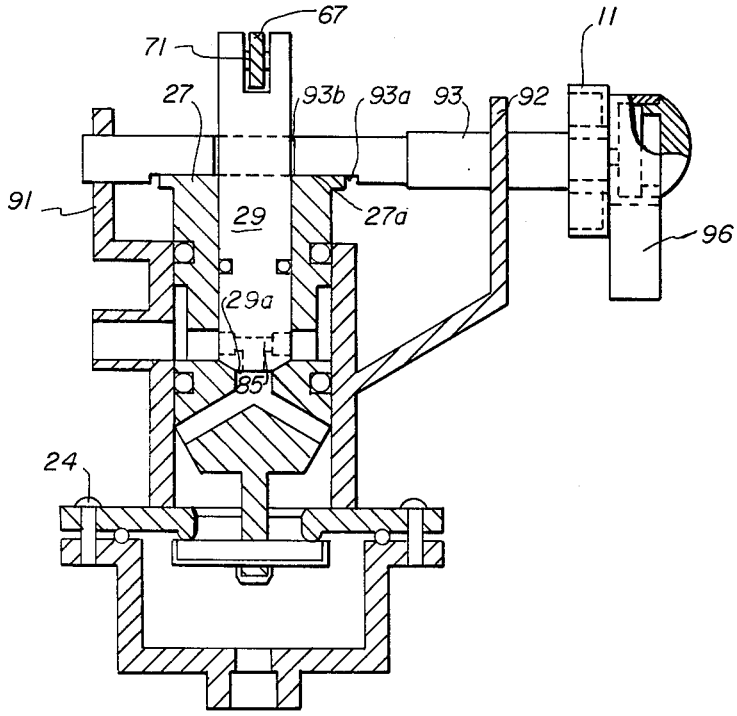
FIG. 2 is a side sectional view of the flush valve of the invention.
Figure 3:
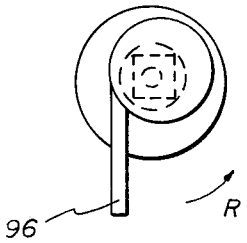
FIG. 3 is a front view of the flush lever incorporated in the flush valve of the invention.

Referring now to FIG. 1, the flush valve of the invention includes a valve housing designated generally by the numeral 14 including an upper portion 16 provided with an inner wall **16*a* and a lower portion 17 having interiors defining an upper chamber 18 and a lower chamber 19. The upper housing portion 16 is provided with a plate 21 having a central opening or orifice 22. The valve housing lower portion 17 is provided with a marginal flange 23 for connecting the housing lower portion 17 to the plate 21 by means of a plurality of circumferentially spaced bolts 24 (FIG. 2). Preferably, sealing means such as an O-ring 26 is provided between the upper and lower housing portion 16, 17** to provide a leak proof connection between the housing portions.

Disposed within the interior 18 of the upper portion 16 of the valve housing 14 are a piston 27 having a central bore 28 for accommodating a valve stem 29, the piston 27 and valve stem 29 being slidably disposed for relative vertical movement independently in the upper chamber 18. The piston 27 and valve stem 29 are provided with O-rings 31, 32 for sealing engagement of the piston 27 and valve stem 29 with the inner wall 16*a* of the upper housing portion 16 and the central bore 28 respectively.

The piston 27 includes an upper portion 33 in which the central bore 28 is disposed and a lower body portion 34 having a valve seat 36 in its upper surface for engagement by the lower end 29*a* of the valve stem 29 thereby forming first valve means for the flush valve of the invention. The valve seat 36 communicates by passage means such as passages 37 in the piston lower body portion 34 with the upper chamber 18. Extending from the bottom surface of the piston lower body portion 34 is an axial extension 38 which extends centrally through the orifice 22 in the plate 21 as shown. The lower end of the axial extension 38 is provided with a support such as a cup 39 in which is positioned a sealing member such as washer 41 of resilient material such as rubber or the like. Thus, upward movement of the piston 27 moves the washer 41 into sealing engagement with an annular lip 22*a* on the plate 21 adjacent the orifice 22 for interrupting communication between the lower chamber 19 and the upper chamber 18 thereby forming the second valve means of the invention.

The flush valve of the invention also includes third valve means provided by the frusto-conical shape of the piston lower body portion 34. More specifically, the tapered surface 34*a* on the piston body 34 is arranged to be accommodated within the orifice 22 as the piston 27 moves downwardly thereby closing the orifice 22 in the lowermost position of the piston 27.

Means are provided for communicating the lower chamber 19 with a source of water under pressure (not shown) which, in the illustrated embodiment, comprises a nipple 43 on the bottom wall of the housing lower portion 17 so that the source of water may be connected by suitable means such as a conduit to the lower chamber 19. The flush valve of the invention also includes means for communicating the upper chamber 18 with the interior 12 of the tank 11. More specifically, the side wall of the housing upper portion 16 is provided with an opening 44 and a tubular extension 46 arranged to accommodate a valve member 47 having a head 47*a* urged by means of a spring 48 into closing engagement with the orifice or opening 44. The interior 49 of the tubular extension 46 is arranged to communicate through a fill pipe 51 extending downwardly in perpendicular relationship therewith, the outer end 51*a* communicating with the interior 12 of the tank 11. Thus, when the orifice 22 is opened, water under pressure flows in the direction of the arrow I through the nipple 43 into the housing lower chamber 19, through the orifice 22 and opening 44 to move the valve member 47 to the right thereby admitting water into the tank 11 through the fill pipe 51.

The flush valve of the invention also includes float means responsive to the water level in the tank 11 and which is operatively connected to the valve stem 29. More specifically, a float designated generally in FIG. 4 by the letter F is connected by linkage means designated generally in FIG. 1 by the reference numeral 52 to the valve housing 14. More specifically, as shown best in FIG. 4, the float F includes a sealed hollow member 54 having an interior 56 and an internally threaded axially extending nipple 57 arranged for threaded engagement with one end of a rod 60, threadedly engageable at its other end with a threaded end portion 58*a* of a substantially L-shaped first link 58. The other end of the link 58 is pivotally connected at 59 to links 61, 62, link 61 being connected at the other end to a laterally extending bracket 63 mounted on the upper portion 16 of the valve housing 14. The other end of the link 62 is pivotally connected at 66 to one end of a substantially horizontally extending link 67. The other end of the link 67 is pivotally connected at 68 to another bracket 69 also mounted on the upper portion 16 of the valve housing 14. Intermediate the ends of link 67, the upper end of the valve stem 29 is pivotally connected at 71 to the link 67. In accordance with one feature of applicant's improved flush valve, the interior 56 of the float F is partially filled with a fluid 72 such as water or the like for a purpose to be explained hereinafter.

The flush valve of the invention also includes a syphon 76 disposed within the interior 12 of the tank 11 with opposite ends 77, 78 communicating with the tank interior 12 and bowl 13 respectively. In the illustrated embodiment, the syphon 76 comprises a tube of U-shaped configuration having an interior 75 with overlying side wall portions 76*a*, 76*b* which define an arcuate bight portion 75*a* within the tube interior 75. The side wall of the syphon 76 is provided with an angularly disposed opening 81 having a nipple 82 disposed therein communicating by means of a hose 83 with ports 84 in the side wall of the piston 27 which communicate with the piston central bore 28 as described in the aforementioned patent. As further described in the aforementioned patent, a valve stem bypass 85 is provided in the valve stem 29 which communicates the upper chamber 18 with all of the ports 84 in the piston 27 through passages 37 when the lower end portion 29*a* of the valve stem 29 is seated in the valve seat 36.

As specifically illustrative of one of the novel features of the improved flush valve of the invention, means are provided on the syphon 76 for breaking the syphon action at a selected level of water W in the tank interior 12 and for reducing the syphon noise during such syphon action. More specifically, a tubular member 87 is suitably supported outside the interior 75 of the syphon 76 adjacent the inlet opening 81, the tubular member having an open lower end 87*a* and an arcuate upper end portion 87*b* terminating in an opening 87*c* in the bight portion 75*a* of the syphon tube exterior 75 as shown best in FIG. 4. Thus, when the level of water W in the tank interior 12 reaches or falls below the tube bottom opening 87*a*, the syphon action is interrupted. Since the top level of water in tank 12 is determined by a fixed elevation of 75*a* the amount of water used for flushing tank 12 is adjusted by cutting off lower end 87*a* of tube 87.

The flush valve of the invention also includes flush means operatively associated with the piston 27. More specifically, as shown best in FIG. 2, a pair of brackets 91, 92 are arranged in oppositely disposed relationship on the valve housing 14 in which a shaft 93 is rotatably mounted. Shaft 93 extends horizontally around valve stem 29 (FIG. 1) so as to permit the valve stem 29 to move vertically in the direction of the double arrow P. The shaft 93 is provided with a flat 93a against which the upper end 27*a* of the piston 27 abuts in the elevated position of the piston 27 as shown in FIGS. 1 and 2. A manually operated flush lever 96 is attached to the outer end of the shaft 93 on the exterior of the tank 11 for manual rotation of the shaft 93 during the flushing operation. A laterally extending arm 97 is attached to the shaft 93 which is preferably of U-shaped configuration and is disposed below the links 67 for movement between the solid line and the broken line positions by rotation of the shaft 93 during the actuation of the flushing operation. In the broken line position of the arm 97, the arm 97 engages the bottom surface of the line 67 thereby providing a stop.

In the operation of the invention, the parts are in the position of FIG. 1 and the tank interior filled with water W to the level shown. The flushing operation is initiated by rotation of the flush lever 96 in a counterclockwise direction as indicated by the arrow R so that the circular surface 93*b* of the shaft 93 engages the upper surface 27*a* of the piston 27 camming the piston 27 downwardly to move the valve seat 36 away from the bottom end 29*a* of the valve stem 29 moving the washer 41 out of engagement with the orifice 22. At this time, the float F is floating on top of the water W in the tank 11. Water is permitted to flow from the water source through the nipple 43, the lower chamber 19, the orifice 22, the passages 37 in the piston 27 between the valve seat 36 and valve stem bottom end 29*a* the ports 84 and through the hose 83, nipple 82 and opening 81 in the syphon 76 initiating the syphon action. Water in the tank 11 therefore is syphoned through opening in the lower end 77 of the syphon 76 and flows through the interior 79 of the syphon 76 into the bowl 13. As the float F moves downwardly with the dropping water level in the tank interior 12, the valve stem 29 is moved downward by the linkage 52 as shown in FIG. 4, the liquid 72 in the float F moving toward the outer end of the float F increasing the leverage on the valve stem 29 through the linkage 52.

As the tank 11 continues to be drained, the downward movement of the float F moves the valve stem lower end 29*a* into sealing engagement with the valve seat 36 to interrupt the flow of water through hose 83 into the syphon 76 except for the small flow through the bypass 85 (to maintain the syphon) with the orifice 22 remaining open. At this time, the build up of water pressure in the upper chamber 18 moves the valve member 47 to the right against the spring 48 so that water from the water source flows through the fill tube 51 into the tank interior 12.

At this time, the tank interior 12 begins to fill with water and the float F again rises to move the valve stem 29 together with the piston 27 back to the position of FIG. 1 shutting off the flow of water through the orifice 22 by engagement of the orifice lip 22*a* with the washer 41. The upward movement of the float F shifts the water 72 inwardly within the float interior 56 to decrease the leverage and therefore let the float F rise quickly with the rise in water level providing a quick and silent shut-off of the water when the proper tank level has been reached.

Having thus described the preferred embodiment of the invention it should be understood that numerous structural modifications and adaptations may be resorted to without departing from the spirit of the invention.

What is claimed is:

1. In a flush valve for a toilet having a tank and a bowl including a valve housing having upper and lower chambers, a piston and a valve stem slidably disposed in said upper chamber for relative vertical movement, first valve means defined by cooperating surfaces on said valve stem and said piston, a syphon communicating at opposite ends with said tank and said bowl, means for communicating said lower chamber with a source of water under pressure and means for communicating said upper chamber with said tank, float means responsive to the water level in said tank operatively connected to said valve stem, flushing means operatively connected with said piston, second valve means actuated by said piston for communicating said housing lower and upper chambers to permit water introduced into said lower chamber from said source to flow into said upper chamber, means including said first valve means for communicating said upper chamber with said syphon, the improvement which comprises, third valve means actuated by said piston for preventing a reverse flow of water from said upper chamber into said lower chamber upon an interruption in the communication between said source of water and said lower chamber.

2. A flush valve in accordance with claim 1 wherein said third valve means comprises an orifice between said lower and upper chambers and wherein said piston includes a body portion adapted for sealing engagement with said orifice in the lowermost position of said piston.

3. A flush valve in accordance with claim 2 wherein said piston body portion is of frusto-conical shape and wherein said housing includes a plate for defining said lower and upper chambers, said plate being provided with a central opening for defining said orifice and wherein the marginal edge of said plate defining said orifice is provided with a bevel for sealing engagement with said piston body portion.

4. A flush valve in accordance with claim 3 wherein said second valve means includes an axial extension on said piston body portion extending within said orifice and a sealing member on the end of said axial extension opposite said body portion for sealing engagement with said orifice in the uppermost position of said piston.

5. A flush valve in acordance with claim 4 wherein said cooperating surfaces include a valve seat on said piston body portion engageable by said valve stem to form said first valve means and fluid passage means in said piston body portion for communicating said upper chamber with said valve seat.

6. A flush valve in accordance with claim 1 wherein said float means includes a float having a interior and linkage means for pivotally connecting said float to said valve housing and to said valve stem, a fluid in said float interior for increasing the leverage on said linkage means during the downward movement of said float as the water in said tank is lowered and to decrease the leverage on said linkage means during the upward movement of said float as the water level in said tank is raised.

7. A flush valve in accordance with claim 6 wherein said linkage means includes a first link having an obliquely extending portion and a horizonally extending portion and means for connecting the outer end of said horizontally extending portion to said float.

8. A flush valve in accordance with claim 7 wherein said linkage means includes a substantially horizontally extending second link and means for pivotally connecting said second link intermediate the ends of said second link to the upper end of said valve stem.

9. A flush valve in accordance with claim 8 wherein said flushing means comprises a flush lever, means for rotatably mounting said flush lever on said housing for movement between an inoperative position and a flushing position, camming means on said mounting means for camming engagement with the upper end of said piston during the movement of said flush lever into said flushing position for downward movement of said piston into a stop position and stop means on said camming means for underlying engagement with said second link in said stop position of said piston.

10. A flush valve in accordance with claim 9 wherein stop means comprise a laterally extending arm on said camming means for said underlying engagement with said second link and movable by said second link to return said flush lever together with said camming means to said operative position.

11. A flush valve in accordance with claim 1 wherein said syphon comprises a tube of U-shaped configuration having overlying side wall portions in abutting relationship to define an arcuate bight portion, said tube communicating at one end with said bowl to define an outlet and at the other end with the interior of said tank to define an inlet and means in said syphon for breaking the syphon action therein at a selected level of water in said tank and for reducing the syphon noise during said syphon action.

12. A flush valve in accordance with claim 11 wherein said syphonaction breaking means includes a vertically extending tubular member adjustably disposed outside of the side wall portion of said syphon having said inlet, said tubular member having one end communicating with said bight portion and the other end communicating with the exterior of said syphon in a predetermined spaced-apart relationship with said inlet.

* * * * *